US010807111B2

(12) United States Patent
Haruch

(10) Patent No.: US 10,807,111 B2
(45) Date of Patent: Oct. 20, 2020

(54) PRESSURIZED AIR ASSISTED FULL CONE SPRAY NOZZLE ASSEMBLY

(71) Applicant: Spraying Systems Co., Wheaton, IL (US)

(72) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 47 days.

(21) Appl. No.: 15/765,322

(22) PCT Filed: Oct. 3, 2016

(86) PCT No.: PCT/US2016/055102

§ 371 (c)(1),
(2) Date: Apr. 2, 2018

(87) PCT Pub. No.: WO2017/059405

PCT Pub. Date: Apr. 6, 2017

(65) Prior Publication Data

US 2018/0290160 A1 Oct. 11, 2018

Related U.S. Application Data

(60) Provisional application No. 62/236,489, filed on Oct. 2, 2015.

(51) Int. Cl.

| | |
|---|---|
| ***B05B 7/04*** | (2006.01) |
| ***B05B 7/10*** | (2006.01) |
| ***B05B 7/06*** | (2006.01) |
| ***B05B 7/08*** | (2006.01) |

(52) U.S. Cl.
CPC ..... *B05B 7/0483* (2013.01); *B05B 7/066* (2013.01); *B05B 7/0861* (2013.01); *B05B 7/10* (2013.01)

(58) Field of Classification Search
CPC ..... B05B 7/0483; B05B 7/066; B05B 7/0861; B05B 7/10
USPC ..... 239/433
See application file for complete search history.

(56) References Cited

U.S. PATENT DOCUMENTS

| | | | | |
|---|---|---|---|---|
| 3,848,807 A * | 11/1974 | Partida | B05B 7/0075 239/290 |
| 5,344,078 A * | 9/1994 | Fritz | B05B 7/0081 239/290 |
| 2004/0056124 A1* | 3/2004 | Haruch | B05B 7/0861 239/690 |

(Continued)

*Primary Examiner* — Chee-Chong Lee
(74) *Attorney, Agent, or Firm* — Leydig, Voit & Mayer, Ltd.

(57) ABSTRACT

A spray nozzle assembly having a nozzle body and a downstream air cap. The air cap has a central opening through which liquid is directed and a plurality of circumferentially spaced air passages oriented at a compound angle to the central flow axis of the air cap opening for directing pressurized air flow streams that interact with discharging liquid for atomizing the liquid while imparting a tangential direction to the atomized liquid for enhanced atomization and a swirling movement into a full cone spray pattern. The air cap may have an integrally formed spray tip or a separate spray tip may be associated with the nozzle body. The air cap may be formed with a downstream conical recess into which liquid and air streams are directed, or alternatively, be designed for atomizing liquid internally within the air cap.

5 Claims, 8 Drawing Sheets

(56) References Cited

U.S. PATENT DOCUMENTS

2005/0284957 A1* 12/2005 Haruch ..... B05B 7/066
239/290

* cited by examiner

PRESSURIZED AIR ASSISTED FULL CONE SPRAY NOZZLE ASSEMBLY

CROSS-REFERENCE TO RELATED APPLICATION

This patent application claims the benefit of U.S. Provisional Patent Application No. 62/236,489, filed Oct. 2, 2015, which is incorporated by reference.

FIELD OF THE INVENTION

The present invention relates generally to spray nozzle assemblies, and more particularly, to air assisted spray nozzle assemblies that utilize pressurized air to facilitate liquid atomization and shaping of the discharging spray patterns.

BACKGROUND OF THE INVENTION

Spray nozzle assemblies are known which utilize a central spray tip for discharging a liquid spray and a separate air cap mounted in surrounding relation to the spray tip for shaping the spray pattern. Such spray nozzle assemblies, however, have been ineffective for generating uniform full cone spray patterns, which is necessary in many coating applications, and particularly when spraying slurries and more difficult to atomize liquids.

Spray nozzle assemblies are known, such as shown in applicant's U.S. Pat. No. 8,960,571, that impart first set of radially directed air streams for transversely interacting and atomizing the liquid and a second set of tangential air streams for forming the liquid into a conical spray pattern. Such spray nozzle assemblies include multiplicities of parts which must be precisely machined or otherwise formed. Other proposals for atomizing slurries with pressurized air, either internally within the nozzle or externally of the nozzle, also have been relatively complex and expensive in construction or ineffective in generating full cone spray patterns.

OBJECTS AND SUMMARY OF THE INVENTION

It is an object of the present invention to provide an improved pressurized air assisted spray nozzle assembly for spraying slurries or other difficult to atomize liquids that is relatively simple in construction while effective in operation.

Another object is to provide an external mix spray nozzle assembly as characterized above which is effective for generating a full cone spray discharge with substantially uniform particle distribution.

A further object is to provide a spray nozzle assembly of the foregoing type having a design that is easily modified for pressurized air atomization of liquids either internally or externally of the nozzle for particular spray applications.

Another object is to provide a spray nozzle assembly of the above kind which has a consolidated liquid spray nozzle and air cap effective for generating a full cone spray pattern of liquids, including slurries and other difficult to atomize liquids.

Other objects and advantages of the invention will become apparent upon reading the following detailed description and upon reference to the drawings.

Figure 1:
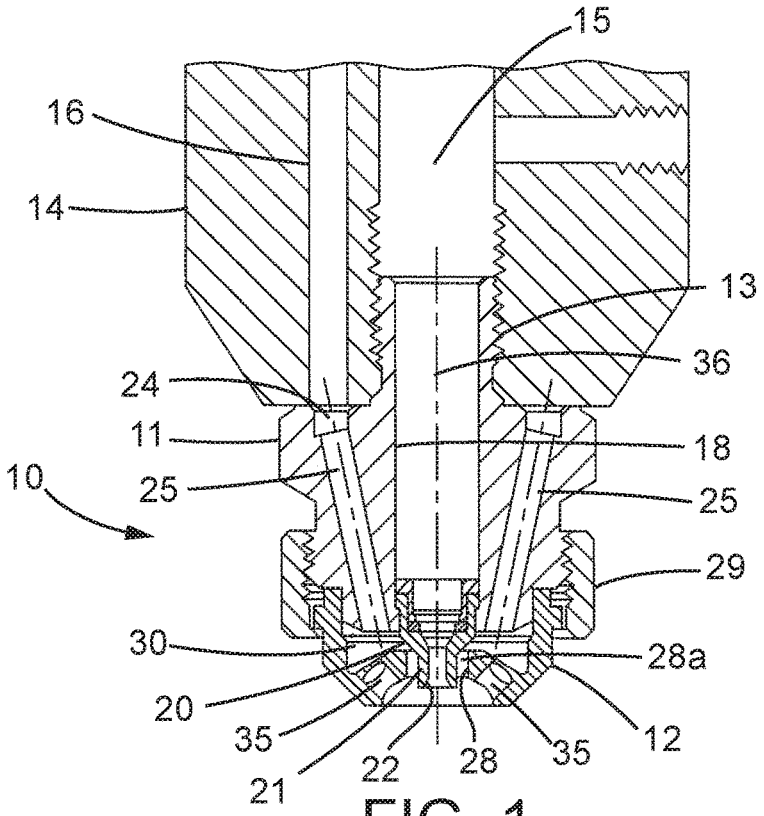
FIG. 1 is a longitudinal section of one embodiment of a spray nozzle assembly in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to FIGS. 1-5 of the drawings, there is shown an illustrative embodiment of a pressurized air assisted liquid spray nozzle assembly 10 in accordance with the invention effective for spraying full cone spray patterns, namely conical spray patterns with liquid particles distributed throughout the pattern. The spray nozzle assembly 10 basically comprises a nozzle body 11 and a downstream air cap 12. The nozzle body 11 in this case has an externally threaded upstream stem 13 for mounting in a conventional spray gun or head 14 having a central liquid supply passage 15 connected to a pressurized liquid supply and one or more pressurized air supply passages 16 circumferentially offset from central liquid supply passage 15 for coupling to a suitable pressurized air supply. The nozzle body 11 has a central liquid flow passage 18 communicating with the liquid supply passage 15 of the head 14, with a spray tip 20 fixedly mounted at a downstream end in a conventional manner. The spray tip 20 has a reduced diameter, forwardly extending nose portion 21 that accelerates the liquid flow stream discharging from a discharge orifice 22 of the nose portion 21. The nozzle body 11 in this case is formed with an annular air passage 24 communicating with the air supply passages 16 of the head 14 and a plurality of pressurized air flow passages 25 communicating from the annular air passage 24 inwardly to a discharge end of the nozzle body 11.

The air cap 12 has a central opening 28 disposed in surrounding relation to the spray tip nose portion 21 and is secured to a downstream end of the nozzle body 11 by a threaded coupling ring 29 in a conventional manner. The air cap 11 in this case defines an internal annular air chamber 30 about the spray tip 20 communicating with the nozzle body air flow passages 25.

Figure 3:
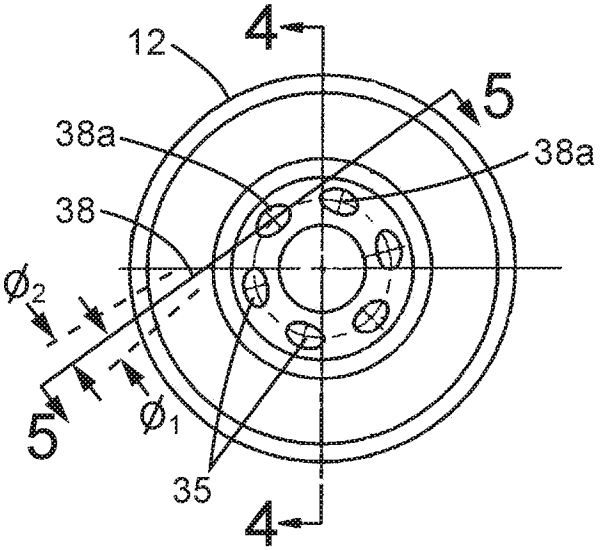
FIG. 3 is an enlarged downstream end view of the air cap of the illustrated spray nozzle assembly.

In accordance with an important feature of this embodiment, the air cap 12 has a plurality of circumferentially spaced pressurized air discharge passages 35 oriented at compound angles with respect to a central flow axis 36 of the central liquid passage 18 and spray tip discharge orifice 22 for atomizing and swirling the liquid discharging from the spray tip 20 into a full cone spray pattern. The illustrated air cap 12 has six circumferentially spaced air discharge passages 35 that each extend along a respective straight axis 38 through the air cap 12 for ease of manufacture. The axis 38 of each air discharge passage 35, when viewed in a plane of the central flow axis 36, extends at an acute angle $\alpha$ to the central flow axis 36 of between 40 degrees and 50 degrees, and preferably about 45 degrees (FIG. 5), and when viewed in a plane perpendicular to the central flow axis 36, the axes 38 of the air discharge passages 35 extend in a line tangential to a circle through the centers 38*a* of the circumferentially located air discharge passages 35 at their downstream ends (FIG. 3). In the illustrated embodiment, the axes 38 of the air discharge passages 35 on opposite sides of the circular array, as viewed form the downstream end as shown in FIG. 3, are in parallel relation to each other.

It will be appreciated by one skilled in the art that the air cap 12 is adapted for efficient manufacture. To that end, the downstream end of the air cap 12 is formed with an inwardly directed frustoconical recess 45 (FIG. 3) in this case defining an angle of about 90 degrees. The air discharge passages 35 may be formed by drilling in perpendicular relation to the conical recess 45 with the drill oriented by rotation at the tangential angle of 45 degrees, as indicated above, to provide the tangential orientation of the air discharge passage 35. The straight line air discharge passage 35 formed in that manner communicates between the conical recess 45 and the internal annular air chamber 30 of the air cap.

Figure 2:
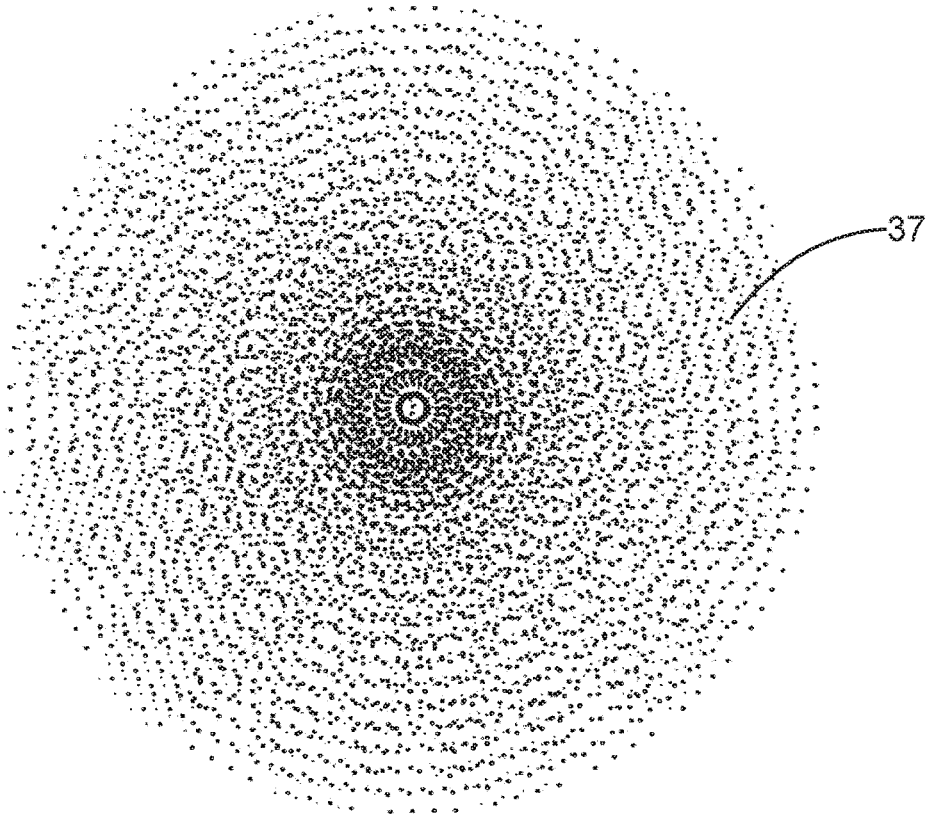
FIG. 2 is transverse view in a plane perpendicular to a central flow axis of the illustrated spray nozzle assembly showing the full cone spray pattern of the discharging liquid.
Figure 5:
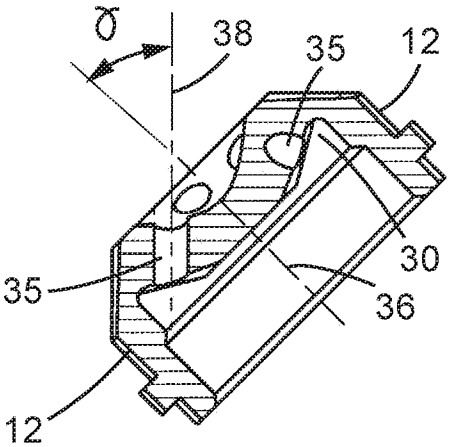
FIG. 5 is a section of the illustrated air cap taken in the plane of line 5-5 in FIG. 3.
Figure 4:
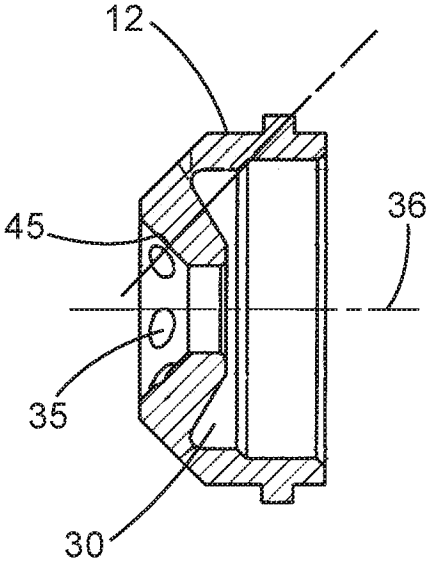
FIG. 4 is a longitudinal section of the illustrated air cap taken in the plane of line 4-4 in FIG. 3.

The pressurized air flow streams discharging from the air discharge passages 35 of the air cap 12 oriented at such compound angles have been unexpectedly found to both interact with the expanding liquid discharging from the spray tip 20 for atomizing the discharging liquid flow stream while imparting a tangential direction to the liquid spray which enhances atomization, and by virtue of the tangential direction of the air streams, impart a swirling movement to the outwardly expanding conical spray pattern with liquid particles distributed throughout the spray pattern 37 (FIG. 2). It has been found that by altering the tangential relation of the air discharge passages 35 with respect to their circular array, the angle of the conical spray pattern can further be controlled. Directing the tangential pressurized air streams inwardly slightly, such as by a small angle "$\phi$1" (FIG. 3) relative to the tangent line of the circular array air discharge passages 35, the tangential pressurized air streams impact more greatly the discharging liquid narrowing the angle of the conical spray pattern. On the other hand, orienting the air discharge passages outwardly by a small angle "$\phi$2" (FIG. 3) relative to the tangent line to the circular array of air discharge passages 35 will enable greater expansion and enlargement of the discharging conical spray. Such angles $\phi$1 and $\phi$2 of deviation from the tangent line 38 preferably are maintained at less than 10 degrees. For the purposes herein, the term "compound angle" of the air discharge passages 35 is intended to mean that the axes 38 of the air discharge passages 35 extend at an acute angle to the central flow axis 36 when viewed in a plane of the central flow axis 36 and when viewed in a plane perpendicular to the central axis imparts a tangential direction to the discharging liquid spray sufficient for forming a well defined full cone spray pattern.

For further controlling the conical angle of the discharging conical spray pattern, the central opening 28 of the air cap 12 may define an annular air flow passage 28*a* about the nose portion 21 of the spray tip 20 communicating with the internal air chamber 30 for directing an annular pressurized air flow stream in close proximity to the discharging liquid from the spray tip 20. This discharging annular air stream further enhances atomization of the expanding liquid, while controlling the angle of the conical spray pattern. More particularly, a relatively large annular passage 28*a* imparts greater influence on the discharging liquid, narrowing the conical spray angle. On the other hand, reducing or eliminating the size of the annular air passage 28*a* about the spray tip nose portion 21 reduces the influence of the central annular discharging air, enabling a greater conical angle of the spray pattern. In either case, a full cone spray pattern results, with particles directed throughout the spray discharge.

It has been found that the liquid flow rate through the spray nozzle assembly 10 is a factor of the viscosity of the sprayed liquid. For example, liquid of 10,000 cp viscosity has been found to have an output spray rate of about 50% of the flow rate of water having the same pressure. Liquid having a viscosity of 2,500 cp is sprayed about 75% the flow rate of water under the same conditions. Through all conditions, the conical angle is maintained within a spray angle of about 60-80 degrees with liquid particles discharged through the spray pattern.

Referring now to FIG. 6-11, there are shown alternative embodiments of pressurized air assisted spray nozzle assemblies in accordance with the invention, wherein items similar to those describe above have been given similar reference numerals. Pursuant to an important feature of these embodiments, the spray nozzle assemblies have a one piece or unitary liquid spray nozzle and air cap construction that further facilitates efficient manufacture and effective generation of full cone liquid spray discharge patterns.

Figure 6:
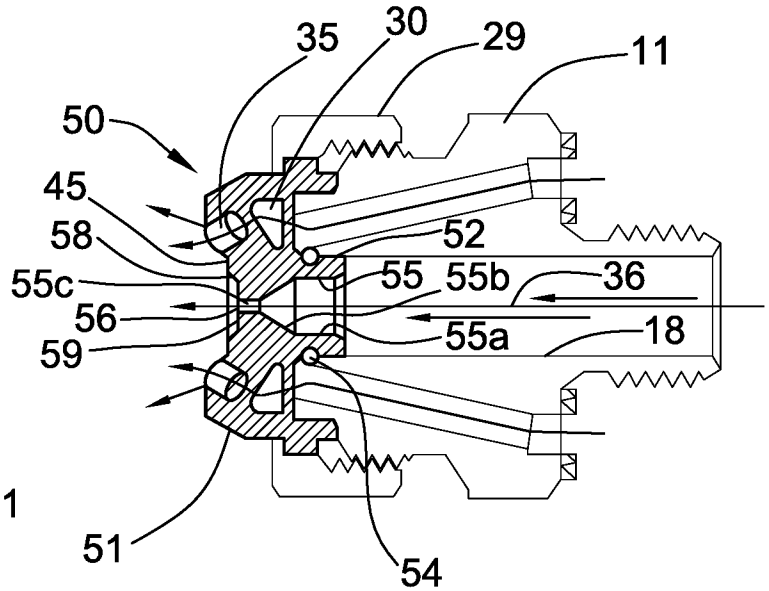
FIG. 6 is a longitudinal section of an alternative embodiment of a spray nozzle assembly which has a unitary liquid spray nozzle and air cap.
Figure 6A:
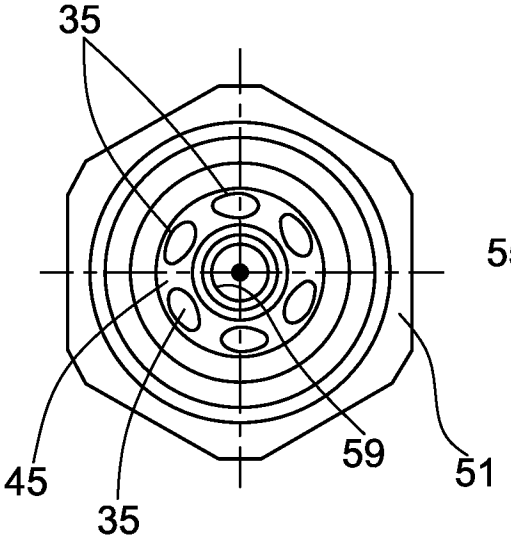
FIG. 6A is a downstream end view of the spray nozzle assembly shown in FIG. 6.
Figure 6B:
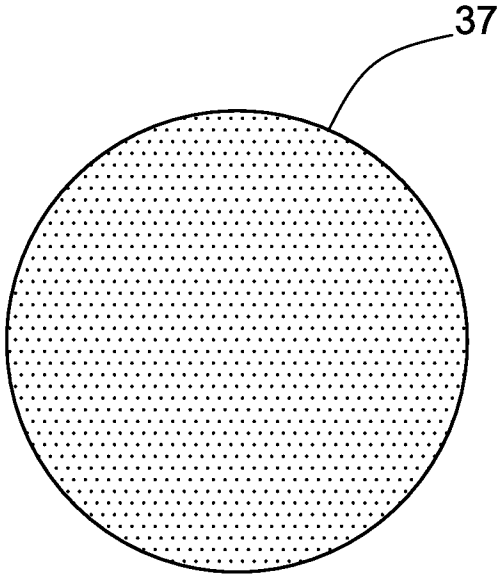
FIG. 6B is a depiction of a cross section of the conical spray discharge of the spray nozzle assembly shown in FIGS. 6 and 6A.

With reference to FIG. 6-6B, an illustrative spray nozzle assembly 50 is shown which has a nozzle body 11 similar to that described above and a one piece liquid spray nozzle and air cap 51 secured to a downstream end of the nozzle body 11 by a threaded annular retainer ring 29. The illustrated spray nozzle and air cap 51 includes an integrally formed upstream annular stem 52 positioned within the central liquid passage 18 of the nozzle body 11 with an annular sealing o-ring 54 interposed therebetween. The stem 52 defines a central liquid nozzling flow passage 55 in this case having a relatively large diameter upstream inlet section 55*a*, an inwardly tapered conical intermediate section 55*b*, and a relatively small annular discharge passage 55*c* which defines a liquid discharge orifice 56 from which a pressurized liquid flow stream is directed from the spray nozzle assembly 50.

In carrying out this embodiment, the one piece spray nozzle and air cap 51 has a plurality of pressurized air discharge passages 35 oriented at compound angles to the central flow axis 36 of the nozzle assembly 50 similar to that described above, each communicating between an annular air chamber 30 within the spray nozzle and air cap 51 and a central conical recess 45 in a downstream end of the spray nozzle and air cap 51. The spray nozzle and air cap 51 in this case is formed with a second conical recess 58 having a smaller conical angle upstream of the first conical recess 45 which extends upstream to a flat end wall 59 transverse to the central flow axis 36 through which the annular discharge passage 55*c* communicates.

The spray nozzle assembly 50 is operable similar to that described above for producing a full cone liquid spray discharge with the liquid flow stream discharging from the central discharge passage 55 of the spray nozzle and air cap 51 being both atomized by a plurality of pressurized air flow streams discharging from the air discharge passages 35 as it expands and shaped into a full cone stray pattern by the tangential orientation of the pressurized air streams. It will be appreciated by one skilled in the art that the one piece construction of the spray nozzle and air cap 51 further facilitates its economical manufacture by enabling both efficient drilling of the straight line air passages 36 through a conical recess 45 as described above, as well as eliminating the necessity for the manufacture and assembly of a separate spray tip.

Figure 7:
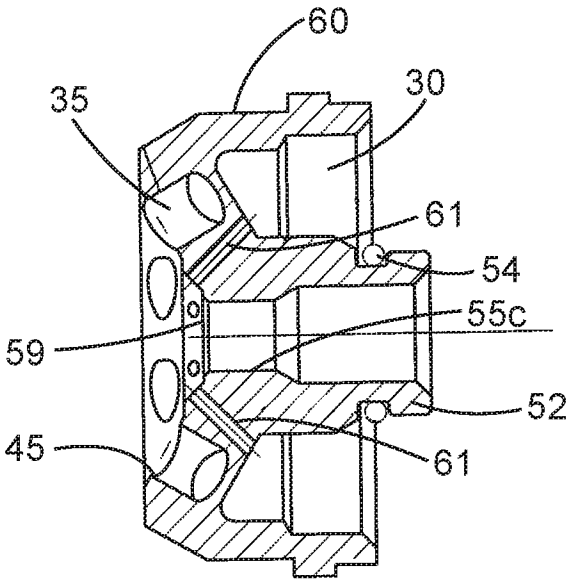
FIG. 7 is a longitudinal section of an alternative embodiment of a unitary liquid spray nozzle and air cap.
Figure 7A:
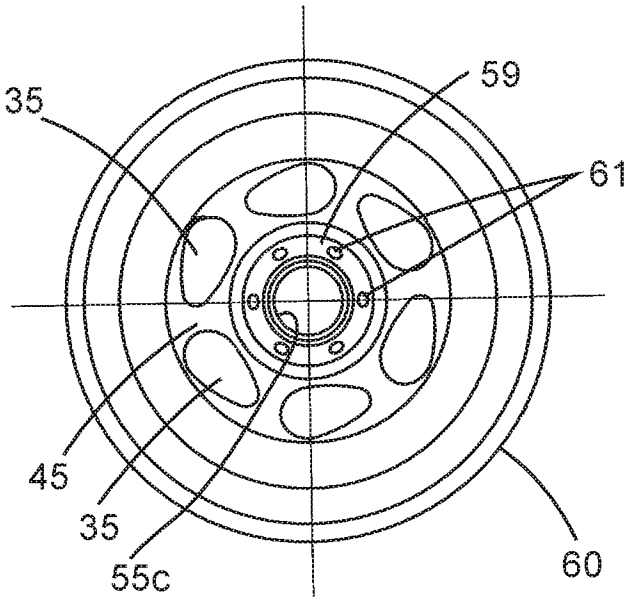
FIG. 7A is a downstream end view of the unitary liquid spry nozzle and air cap shown in FIG. 7.

Referring to FIGS. 7 and 7A, there is shown an alternative embodiment of a unitary spray nozzle and air cap 60, substantially similar to that shown in FIG. 6, particularly adapted for atomizing and spraying even more viscous liquids. In this case, the composite spray nozzle and air cap 60 includes a plurality of tangentially oriented air discharge passages 35 extending at compound angles to the central flow avis of the spray nozzle as indicated above and a second set of supplemental smaller diameter air atomizing discharge passages 61 formed in a circular array within the array of tangentially oriented air discharge passages 35. The supplemental atomizing air passages 61 in this case do not have a tangential orientation, but rather extend in planes common to the central flow axis such that the discharging supplemental air streams directly intersecting the liquid immediately upon discharge from the discharge passage 55*c* and prior to influence from the tangentially directed pressurized air streams from the tangential air discharge passage 35. The supplemental atomizing air discharge passages 61 preferably are about ⅓ the diameter of the tangentially oriented air discharge passages 35 for directing more intensified pressurized air streams into direct intersecting relation to discharging liquid for facilitating atomization of even very viscous liquids. In a typical embodiment, the supplemental atomizing air passages 61 may have a diameter of 0.028 inches and the tangentially oriented air discharge passages have a diameter of 1.10 inches. The supplemental atomizing air discharge passages 61 preferably are disposed in a circular array at circumferential locations intermediate the tangentially oriented air discharge passages 35.

To facilitate manufacture of the unitary spray nozzle and air cap 60, it again has a first conical recess 45 extending inwardly from a downstream end having a relatively large conical angle, such as 120 degrees, and a second conical recess 59 at a smaller conical angle extending inwardly and upstream of the first conical recess 45. The tangentially oriented air discharge passages 35 can be drilled or otherwise formed through the first conical recess 45 and the supplemental air discharge atomizing passages 61 can be drilled in perpendicular relation to the second conical surface 59. By virtue of such arrangement, as indicated above, the atomizing air streams discharging from the supplemental air atomizing passages 61 interact and atomize the discharging liquid flow stream prior to the interaction of pressurized air from the tangentially oriented discharge passages 35 which then further enhance atomization of the expanding atomized liquid and shape it into a conical full cone spray pattern.

Figure 8:
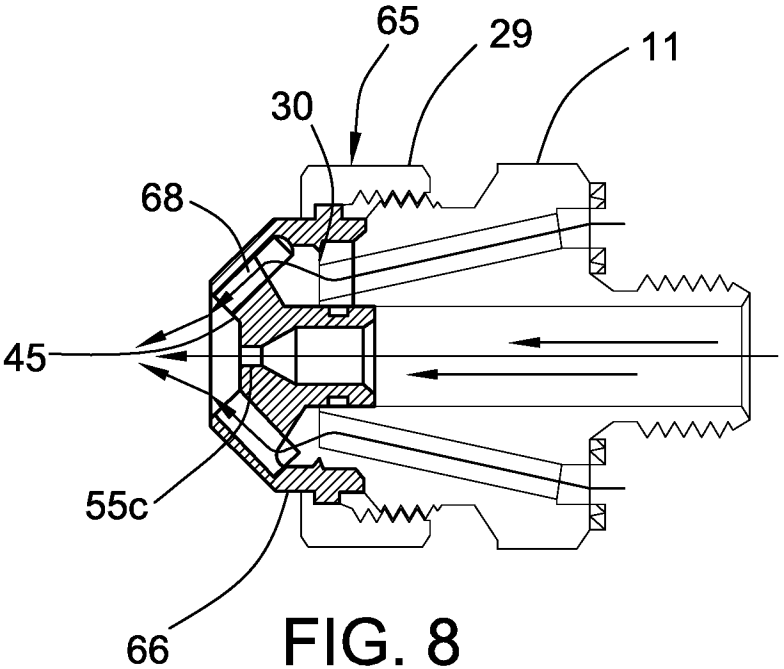
FIG. 8 is a longitudinal section of a spray nozzle assembly having another alternative embedment of a one piece liquid spray nozzle and air cap.
Figure 8A:
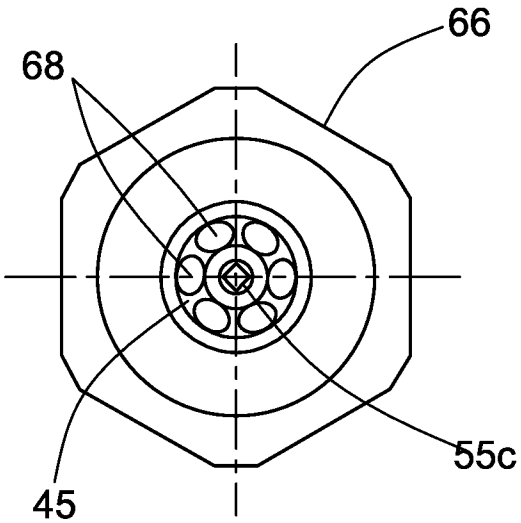
FIG. 8A is a downstream end view of the spray nozzle assembly shown in FIG. 8.
Figure 8B:
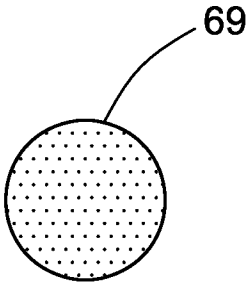
FIG. 8B is a transverse section of a relatively smaller diameter conical spray pattern discharge from the spray nozzle assembly shown in FIGS. 8 and 8A.

In further keeping with the invention, the composite one piece spray nozzle and air cap may be easily modified further for particular spray applications. With reference to FIGS. 8-8B, there is shown a spray nozzle assembly 35 operable for producing a relatively smaller diameter full cone spray pattern. In this case, the nozzle assembly 65 has a spray nozzle and air cap 66 formed with a conical recess 45 having a relatively smaller conical angle through which a plurality of circumferentially spaced air discharge passages 68 communicate without a tangential orientation as described above such that the discharging pressurized air flow streams directly impact and interact with liquid at a location in closer proximity to liquid discharging from the discharge passage 55*c* for converging the spray into a smaller, yet conical, spray pattern 69, (FIG. 8B).

Figure 9:
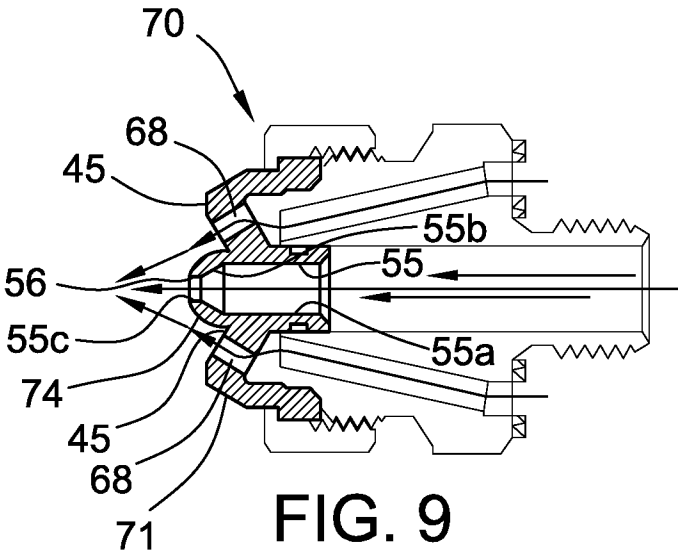
FIG. 9 is a longitudinal section of a spray nozzle assembly having still another embodiment of a unitary liquid spray nozzle and air cap.
Figure 9A:
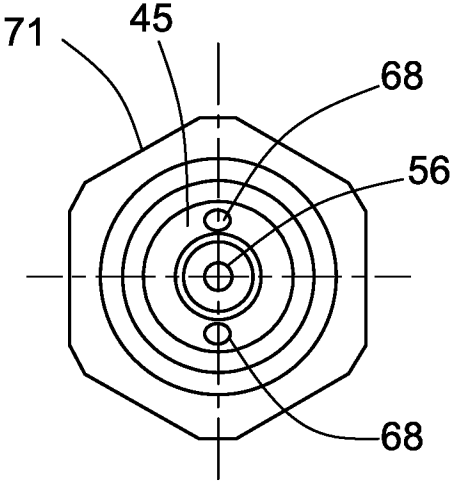
FIG. 9A is downstream end view of the spray nozzle assembly shown in FIG. 9.
Figure 9B:
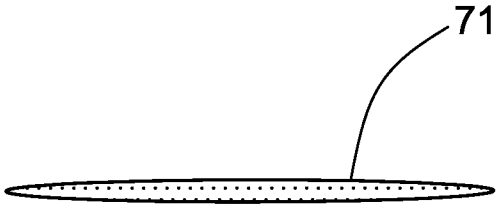
FIG. 9B is a transverse section of a flat spray pattern discharged by the spray nozzle assembly shown in FIGS. 9 and 9A.

Referring to FIGS. 9-9B, there is shown a spray nozzle assembly 70 having a one piece spray nozzle and air cap 71 effective for generating a flat spray pattern. In this case, the spray nozzle and air cap 71 is formed with a hollow dome 74 disposed within the conical recess 45 protruding in a downstream direction through which a circular liquid discharge passage 55*c* centrally communicates. For forming the discharging liquid into a flat spray pattern, a pair of air discharge passages 68 are provided in the conical recess 45 on opposite sides of the liquid discharge orifice 56 for directing a pair of pressurized air streams into direct intersecting relation with discharging liquid, i.e. without a tangential orientation, for both atomizing the liquid and forming it into a flat spray pattern (FIG. 9B). In this instance, with the liquid discharge orifice 56 being formed in the protruding hollow dome 71, it is disposed in downstream relation to the air direction passages 68.

Figure 10:
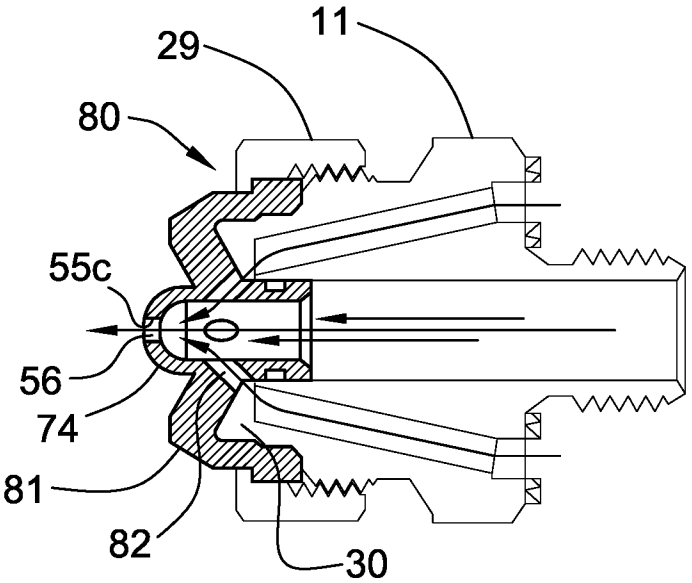
FIG. 10 is a longitudinal section of another embodiment of a spray nozzle assembly having a one piece spray nozzle and air cap.
Figure 10A:
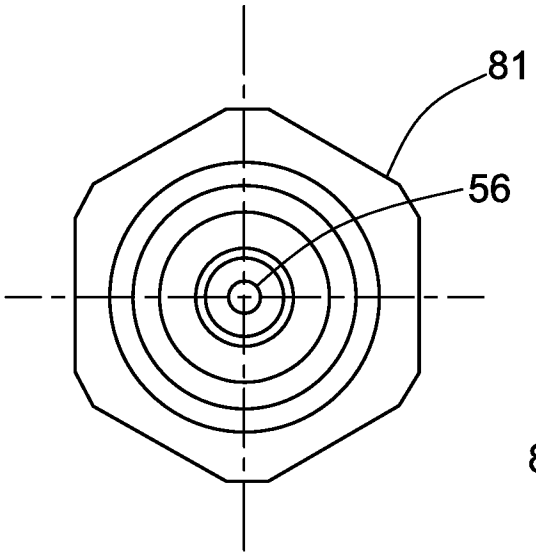
FIG. 10A is a downstream end view of the spray nozzle assembly shown in FIG. 10.
Figure 10B:
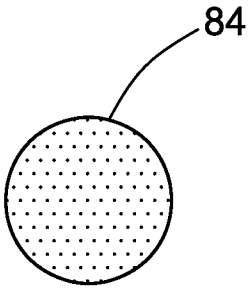
FIG. 10B is a transverse section of the relatively small diameter conical spray pattern generated by the spray nozzle assembly shown in FIGS. 10 and 10A.

In further keeping with the invention, the composite spray nozzle and air cap further can be modified to function as in internal mix air atomizing spray nozzle. With reference to the embodiment of FIGS. 10-10B, there is shown a spray nozzle assembly 80 having a spray nozzle and air cap 81 which again has a protruding dome 74 formed with a circular liquid discharge orifice 56. For atomizing liquid directed through the liquid flow passage 55, the spray nozzle and air cap 81 in this case is formed with a plurality of internal atomizing air passages 82 communicating between the annular air chamber 30 and the liquid flow passage 55 for internally intermixing and atomizing the liquid prior to discharge from the liquid discharge passage 55*c*. The atomizing air passages 82 have flow axes in intersecting relation to the central flow axis 36 for maximum interaction with the liquid flow stream prior to discharge from the spray nozzle assembly. Depending upon the size of the liquid discharge passage 56, a relatively small full cone spray pattern 84 can be produced, as depicted in FIG. 10B.

Figure 11:
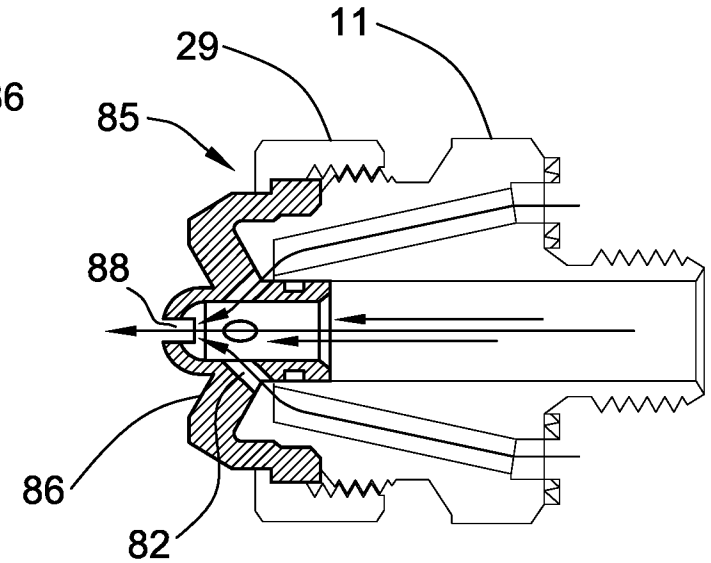
FIG. 11 is a longitudinal section of an alternative embodiment of a spray nozzle assembly having a one piece spray nozzle and air cap.
Figure 11A:
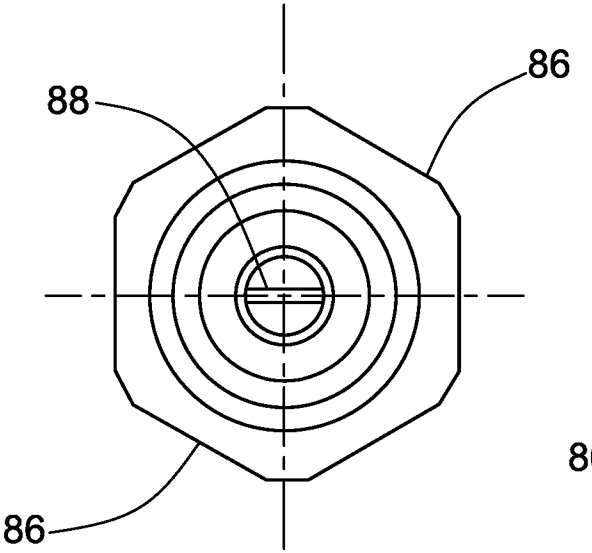
FIG. 11A is a downstream end view of the spray nozzle assembly shown in FIG. 11.
Figure 11B:
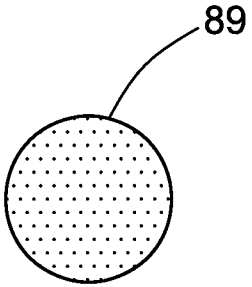
FIG. 11B is a transverse section of the flat spray pattern generated by the spray nozzle assembly shown in FIGS. 11 and 11A.

With reference to FIGS. 11-11B, there is shown an internal mix pressurized air assisted spray nozzle assembly 85 effective for generating a flat spray pattern. The spray nozzle and air cap 86 is similar to that shown in FIG. 10, but has a discharge orifice defined by a cross slit 88 through the dome 74 such that the liquid pre-atomized within the spray nozzle and air cap 86 is shaped into a flat narrow spray pattern 89 (FIG. 11B).

From the foregoing, it can be seen that a pressurized air assisted spray nozzle assembly is provided for spraying slurries and other difficult to atomize liquids that is relatively simple in construction while effective in operation. The spray nozzle assembly is effective for generating full cone spray patterns and the design can be easily modified for pressurized air atomization of liquids either internally or externally of the spray nozzle for particular spray applications.

The invention claimed is:

1. A spray nozzle assembly comprising:

a nozzle body having a liquid flow passage for connection to a pressurized liquid supply and for directing liquid through said nozzle body for discharge from said spray nozzle assembly;

said nozzle body having at least one air passage for connection to a pressurized air supply;

an air cap mounted on a discharge end of said nozzle body;

said air cap having a central opening through which liquid directed through said nozzle body passes for discharge from said spray nozzle assembly along a central flow axis of said air cap central opening, said air cap having a single circumferentially spaced array of air direction passages about said central opening communicating with said at least one nozzle body air passage;

a spray tip disposed at a downstream end of said nozzle body communicating with said liquid flow passage and having a reduced diameter forwardly extending nose portion for accelerating a liquid flow stream discharging from a discharge orifice of the nose portion;

said air cap being formed with a central recess in a downstream end of the air cap; and each air direction passages of said single circumferentially spaced array of air direction passages being oriented at a compound angle to the central flow axis of said air cap central opening for directing pressurized air flow streams into said central recess that interact with liquid discharging from said spray tip for atomizing the discharging liquid flow stream while imparting a tangential direction to the atomized liquid that enhances atomization and a swirling movement to the discharging liquid into an expanding conical spray pattern with liquid particles distributed throughout the spray pattern.

2. The spray nozzle assembly of claim 1 in which said air cap defines an internal annular air chamber communicating between said at least one nozzle body air passage and said single circumferentially spaced array of air direction passages of said air cap.

3. The spray nozzle assembly of claim 1 in which air direction passages of said single circumferentially spaced air direction passages of said air cap each have an axis which when viewed in a plane of the central flow axis that extends at an acute angle to the central flow axis of said air cap central opening of between 40 and 50 degrees and when viewed in a plane perpendicular to the central flow axis of said air cap opening extend in a line tangential to a circle through the centers of the air direction passages of said single circumferentially exposed array of air direction passages of said air cap at their downstream ends.

4. The spray nozzle assembly of claim 1 in which the air direction passages of said single circumferentially spaced air direction passages of said air cap each have an axis that extends at an acute angle to the central flow axis when viewed in a plane of the central flow axis and when viewed in a plane perpendicular to the central flow axis is oriented within ten degrees of a line tangential to a circle through the centers of the air direction passages of the single circumferential array of air direction passages at their downstream ends.

5. The spray nozzle assembly of claim 1 in which all air direction passages of said single circumferentially spaced array of air direction passages on opposite sides of said single circumferentially spaced array of air passages have axes oriented in parallel relation to each other.

* * * * *